United States Patent [19]

Muraki et al.

[11] Patent Number: 4,545,009

[45] Date of Patent: Oct. 1, 1985

[54] FUEL COMBUSTION CONTROL SYSTEM

[75] Inventors: Ryoji Muraki, Nishinomiya; Seiiti Numata, Wakayama; Kanji Hayashi, Takatsuki, all of Japan

[73] Assignee: Kurashiki Boseki Kabushiki Kaisha, Okayama, Japan

[21] Appl. No.: 444,686

[22] Filed: Nov. 26, 1982

[30] Foreign Application Priority Data

Nov. 30, 1981 [JP] Japan ..... 56-193226

[51] Int. Cl.[4] ..... G05B 13/02; F23N 5/00; F23N 50/08

[52] U.S. Cl. ..... 364/164; 364/165; 364/494; 431/12; 431/24; 431/76

[58] Field of Search ..... 364/164, 165, 133, 139, 364/494, 495; 431/12, 24, 26, 76, 78, 90

[56] References Cited

U.S. PATENT DOCUMENTS

| | | | |
|---|---|---|---|
| 4,043,742 | 8/1977 | Egan et al. | 364/139 X |
| 4,277,832 | 7/1981 | Wong | 364/133 X |
| 4,319,320 | 3/1982 | Sato et al. | 364/165 |
| 4,348,169 | 9/1982 | Swithenbank et al. | 431/24 X |
| 4,430,698 | 2/1984 | Harris | 364/164 X |
| 4,449,918 | 5/1984 | Spahr | 431/76 |
| 4,492,559 | 1/1985 | Pocock | 431/12 |

FOREIGN PATENT DOCUMENTS

| | | | |
|---|---|---|---|
| 121320 | 9/1980 | Japan | 431/12 |
| 198920 | 12/1982 | Japan | 431/12 |

OTHER PUBLICATIONS

"Distributed Computer Control of Fossil-Fired Power Stations". Electrical Review, vol. 204, No. 20, (May 25, 1979) pp. 30-34.

*Primary Examiner*—Jerry Smith
*Assistant Examiner*—Jon D. Grossman
*Attorney, Agent, or Firm*—Berman, Aisenberg & Platt

[57] ABSTRACT

Estimated fuel flow rate is calculated by reading first data of the relationship between the opening degree of a fuel control valve and a fuel flow rate. Then, a compensation coefficient is calculated based on the estimated fuel flow rate, and the actual fuel flow rate is controlled on the basis of the compensation coefficient. Estimated excess air ratio is calculated by reading second data representing the relationship between the opening rate of an air control damper and the air flow rate. Then, the actual fuel flow rate and the air flow rate are controlled depending on the predetermined relationship of values between the estimated excess air ratio and the desired excess air ratio.

4 Claims, 13 Drawing Figures

21-2

FIG. 6a

| VALVE OPENING DEGREE F(x) (%) | FUEL FLOW RATE x (ℓ/min.) | FUNCTION a + bx | |
|---|---|---|---|
| 0 | 0 | 0 + 11.67 x | a231 |
| 21 | 1.8 | 0 + 11.67 x | a232 |
| 42 | 3.6 | 4.20 + 10.53 x | |
| 62 | 5.5 | 14.20 + 8.70 x | |
| 82 | 7.8 | 18.0 + 8.18 x | a235 |
| 100 | 10.0 | ——— | |

21-3

FIG. 6b

| DAMPER OPENING DEGREE F(x) (%) | AIR FLOW RATE x (%) | FUNCTION a + bx | |
|---|---|---|---|
| 0 | 0 | 0 + 0.733 x | a 331 |
| 22 | 30 | 1.64 + 0.678 x | a 332 |
| 41 | 58 | −23.44 + 1.111 x | |
| 61 | 76 | −38.75 + 1.313 x | |
| 82 | 92 | −125.00 + 2.25 x | a 335 |
| 100 | 100 | ——— | |

21-4

FIG. 6c

| FUEL FLOW RATE (ℓ/min.) | M | FUNCTION a + bx | |
|---|---|---|---|
| 2.0 | 1.30 | 1.5 − 0.1 x | a 431 |
| 4.0 | 1.10 | 1.10 | a 432 |
| 10.0 | 1.10 | | |

FUEL COMBUSTION CONTROL SYSTEM

FIELD OF THE INVENTION

The present invention relates to a fuel combustion control system for use in heating of a heating object such as a boiler, and more particularly, to a control system thereof.

BACKGROUND OF THE INVENTION

In general, a fuel combustion control system for use in a boiler, particularly a middle-sized or small-sized boiler with the steam pressure controlled to a desired value comprises a fuel valve for controlling the fuel flow rate and an air damper for controlling air flow rate which are connected with each other by a connecting means such as a link member or a cam means. In such a fuel combustion control system, in order to achieve complete combustion of the fuel, it is required to maintain the fuel flow rate and the excess-air ratio in a required relation. For this purpose, according to the conventional method, it is necessary to obtain data indicating the relation between the opening degree of the fuel valve and the fuel flow rate and the relation between the opening degree of the air damper and the air flow rate by preliminarily operating the fuel combustion control system with the boiler in advance to actual operation of the same, whereby the link member between the fuel valve and the air damper is controlled by the operator on the basis of said data so that desired complete combustion can be achieved.

However, in the conventional fuel combustion control system, since the relation between the opening degree of the air damper or the fuel valve and the volume of air in the burner of the boiler is liable to be delicately changed, the link member should be controlled repeatedly, requiring skill and intuition of the operator.

For overcoming the aforementioned disadvantage, the inventors proposed a fuel combustion control system by relating Japanese patent application No. 81374/1981 which aims at simple and reliable operation of the fuel combustion control system by preliminarily operating the control object, such as a fuel combustion control system, for use in a boiler to obtain data indicating the relation between the opening degree of the fuel valve and the fuel flow rate, the relation between the opening degree of the air damper and the air flow rate and the relation between the fuel flow rate and the excess-air ratio, based on which the opening degrees of the fuel valve and the air damper are automatically and appropriately controlled.

However, the fuel used in the fuel combustion control system, e.g., G heavy oil is not always manufactured under the same conditions, and the physical characteristics, especially kinematic viscosity of the fuel, are fluctuated by heating of the fuel for facilitating atomization thereof in the burner and by fluctuation of the pressure at the pump for supplying the fuel, leading to errors between the estimatcd data of the relation between the fuel flow rate and the valve opening degree and the relation between the fuel flow rate and the excess-air ratio and the actual values thereof in actual operation of the fuel combustion control system, thereby causing reduction of accuracy in the controlling operation.

For overcoming the aforementioned disadvantage, it may be considered to update the aforementioned data whenever the manufacturing condition of the fuel is changed and the heating temperature of the fuel for atomization thereof is changed, though, in this case, the updated data must be manually re-inputted into the system, leading to reduction in operation workability.

SUMMARY OF THE INVENTION

The present invention contemplates overcoming the aforementioned disadvantages which are inherent in the prior art. Its essential object is to provide a fuel combustion control system which enables keeping 2 desired relationship between the fuel flow rate and the excess-air ratio to the fuel combustion control system for complete combustion without being influenced by variation in the fuel characteristics.

Another object of the present invention is to provide a fuel combustion control system which enables change of driving characteristics depending on the characteristics of the fuel employed in the fuel combustion control system so that desired complete combustion is made.

A further object of the present invention is to provide a fuel combustion control system which enables suppression of overshooting of control thereby assuring stabilized fuel combustion control for the fuel combustion control system.

According to one aspect of the present invention, there is provided a fuel combustion control system which comprises:

a burning device for burning fuel applied thereto with excess air so as to heat a control object;

fuel flow rate control means for controlling the fuel flow rate to the burning device by adjusting the opening degree of the fuel flow rate control means;

air flow rate control means for controlling the air flow rate to the burning device by adjusting the opening degree of the air flow rate control means;

operation means for calculating a desired fuel flow rate on the basis of the desired output value of the control object and the actual output value of the control object;

memory means for storing first data showing at least one relation between the fuel flow rate and the opening degree of the fuel flow rate control means;

calculation means for calculating an estimated fuel flow rate on the basis of data representing the actual opening degree of the fuel flow rate control means and the data representing the fuel flow rate stored in the memory means; and means for compensating said desired fuel flow rate on the basis of the difference between the actual fuel flow rate and the estimated fuel flow rate.

To achieve said further object of the present invention, there is provided a fuel combustion control system which comprises:

a burning device for burning fuel applied thereto with excess air so as to heat a control object;

fuel flow rate control means for controlling the fuel flow rate to the burning device by adjusting the opening degree of the fuel flow rate control means;

air flow rate control means for controlling the air flow rate to the burning device by adjusting the opening degree of the air flow rate control means;

operation means for calculating a desired fuel flow rate on the basis of the desired output value of the control object and the actual output value of the control object;

memory means for storing first data showing at least one relation between the fuel flow rate and the opening degree of the fuel flow rate control means;

second data showing relation between the excess-air ratio and the opening degree of the air flow rate control means and third data showing the relation between the fuel flow rate and the excess-air ratio;

calculation means for calculating an estimated fuel flow rate on the basis of data representing an actual opening degree of the fuel flow rate control means and the data representing the fuel flow rate stored in the memory means;

means for compensating said desired fuel flow rate on the basis of the difference between the actual fuel flow rate and the estimated fuel flow rate;

second calculating means for calculating a desired excess-air ratio relative to the desired fuel flow rate on the basis of the third data in the memory means;

third calculating means for calculating an estimated excess-air ratio;

comparing means for comparison of the desired excess-air ratio and the estimated air ratio to produce an output only when the estimated air ratio is larger than or equal to the desired air ratio; and means for allowing change of the opening degree of the fuel flow control means.

These and other objects and the features of the present invention will be apparent from the following example of the embodiment.

BRIEF EXPLANATION OF THE DRAWINGS

FIGS. 6*a* through 6*c* are tables respectively showing examples of the first, second and third data memorized in a random access memory 21 of the system shown in FIG. 2;

DESCRIPTION OF THE PREFERRED EMBODIMENT

Figure 1:
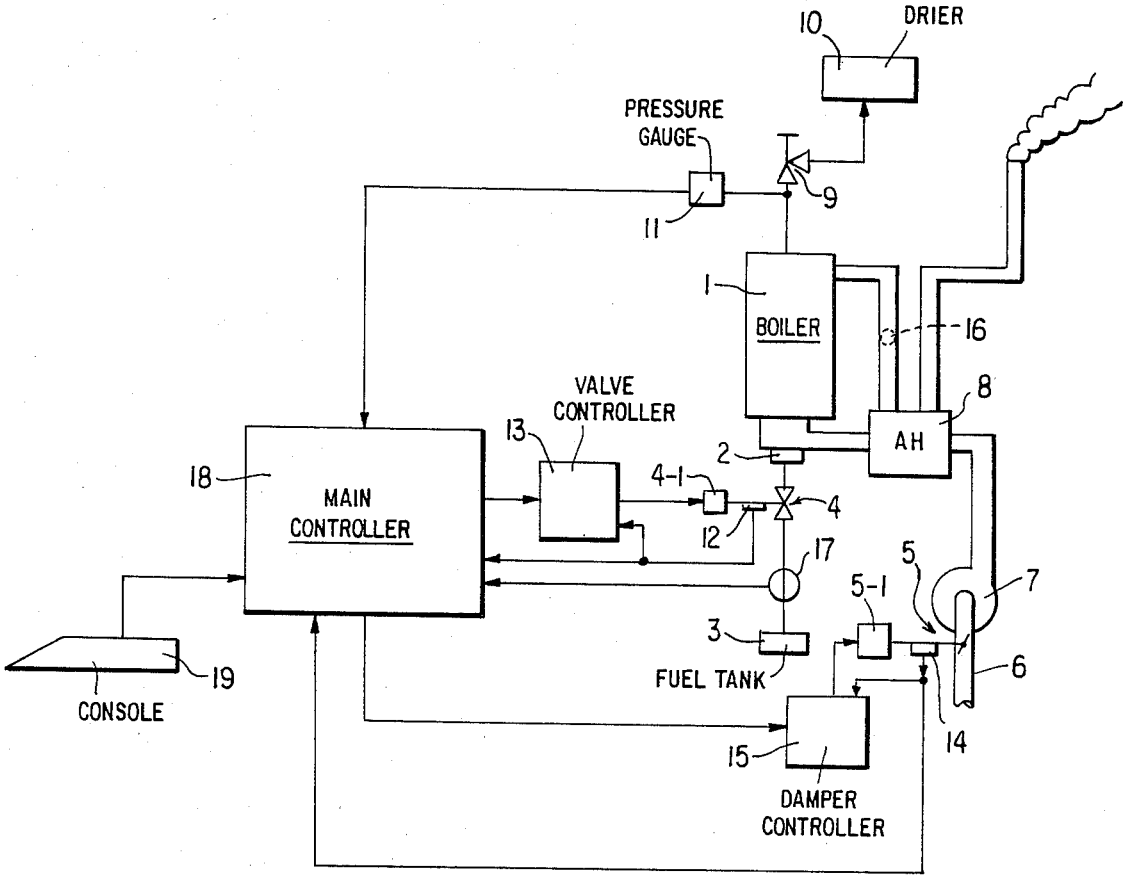
FIG. 1 is a schematic diagram illustrating the fuel combustion control system according to the present invention.

Referring now to FIG. 1 of the drawings, there is shown a fuel combustion control system which comprises a boiler 1 provided with a burner 2, a fuel tank 3 for feeding liquid fuel to the burner 2 through a control valve 4 for controlling the flow rate of the fuel and an air duct 6 provided with an air damper 5 and adapted to supply air to the burner 2 through a positive blower 7 and an air preheater 8. Steam from the boiler 1 is transferred to, e.g., a drier 10 through a valve 9 for controlling the flow rate of the boiler steam.

The fuel combustion control system further includes a pressure gauge 11 which is interposed between the boiler 1 and the valve 9, a potentiometer 12 acting in association with operation of the control valve 4 for transmitting a voltage signal representing the opening degree of the control valve 4, a valve controller 13 for controlling opening and closing of the control valve 4, another potentiometer 14 acting in association with the air damper 5 for transmitting a voltage signal representing the opening degree of the air damper 5, a damper controller 15 for operating the air damper 5 to control the volume of air flowing into the air duct 6, an oxygen density analyzer 16 arranged within the exhaust gas passage of the boiler 1 for detecting the density of oxygen contained in the exhaust gas and an integrating flow meter 17 of a known type interposed between the fuel tank 3 and the control valve 4 for measuring the flow rate of the fuel to indicate the accumulated value thereof in a digital manner and to output one pulse every time a predetermined amount of the fuel is detected, e.g., one pulse upon detection of flow in the amount of 10.

Reference numeral 18 indicates a main controller, which is formed by a read only memory (ROM) having stored the control program, a random access memory (RAM), an operation circuit performing various operations or a microcomputer having a decision circuit.

The main controller 18 is connected with the pressure gauge 11, the potentiometers 12 and 14 and the integrating flow meter 17, and with a console 19 having a data input operation switch (not shown) for operating input of various data and various function switches (not shown): The main controller 18 receives signals indicating the detected values of the steam pressure of the boiler 1, the opening degree of the control valve 4, the opening degree of the air damper 5 and a pulse signal based on the flow rate of the fuel pressure gauge 11, the potentiometers 12 and 14 and the integrating flow meter 17, respectively, as well as signals indicating operation orders and various data from the console 19 so as to transmit operation control signals, respectively, to the valve controller 13 and the damper controller 15. Motor 4-1 operates the control valve 4, and motor 5-1 operates the air damper 5.

It is to be noted that the potentiometer 12 and the valve controller 13 form a fuel flow control loop for the control valve 4 while the potentiometer 14 and the damper controller 15 form an air flow control loop for the air damper 5.

FIG. 2 shows a circuit diagram of the main controller 18 as shown in FIG. 1. The central processing unit (not shown) of the main controller 18 is formed by, e.g., a microprocessor for performing operation orders toward various circuits within the main controller 18.

Figure 2A:
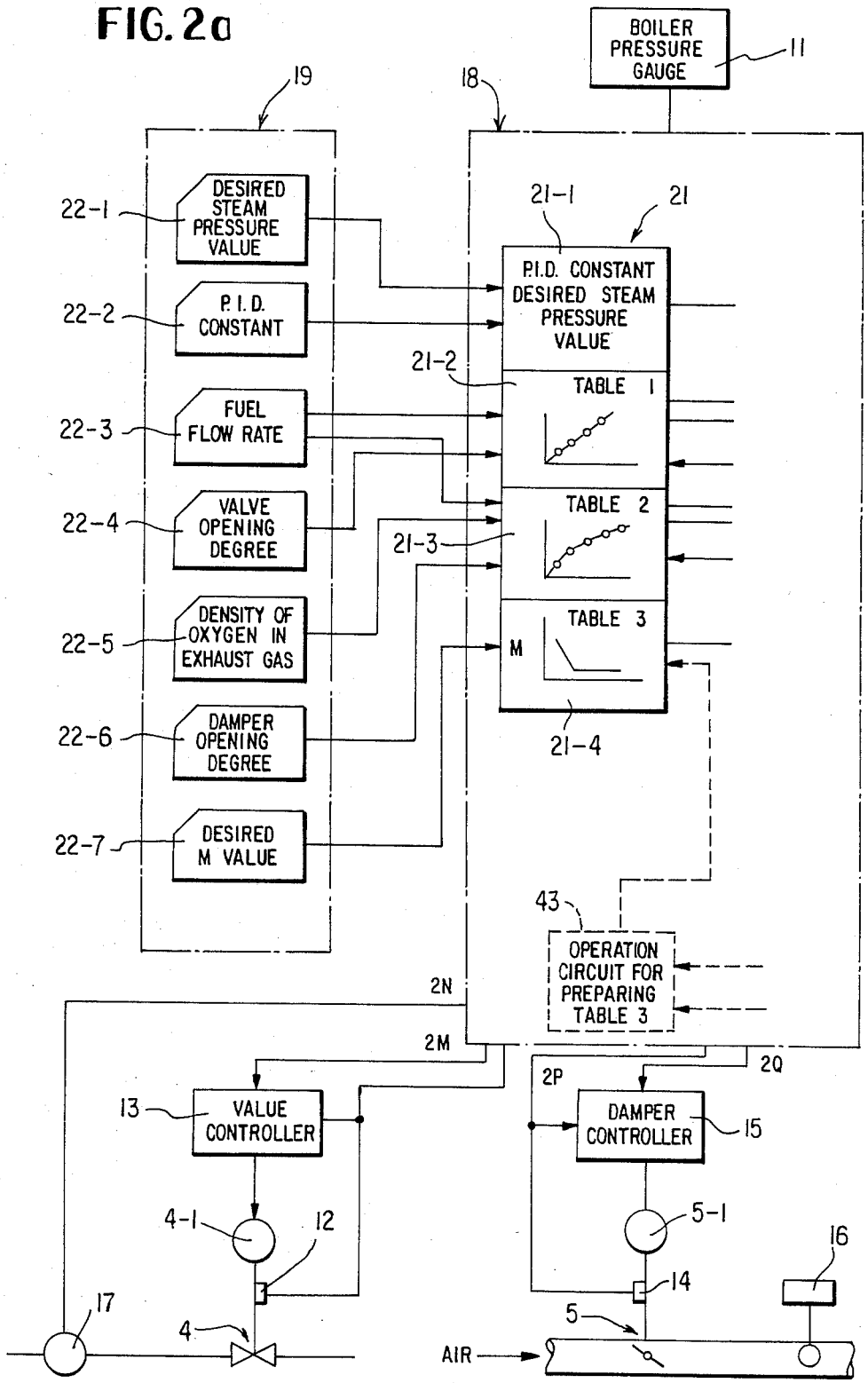
FIG. 2 is comprised of FIGS. 2*a* through FIG. 2*c* showing a circuit diagram of an embodiment of the fuel combustion control system of the present invention.
Figure 2B:
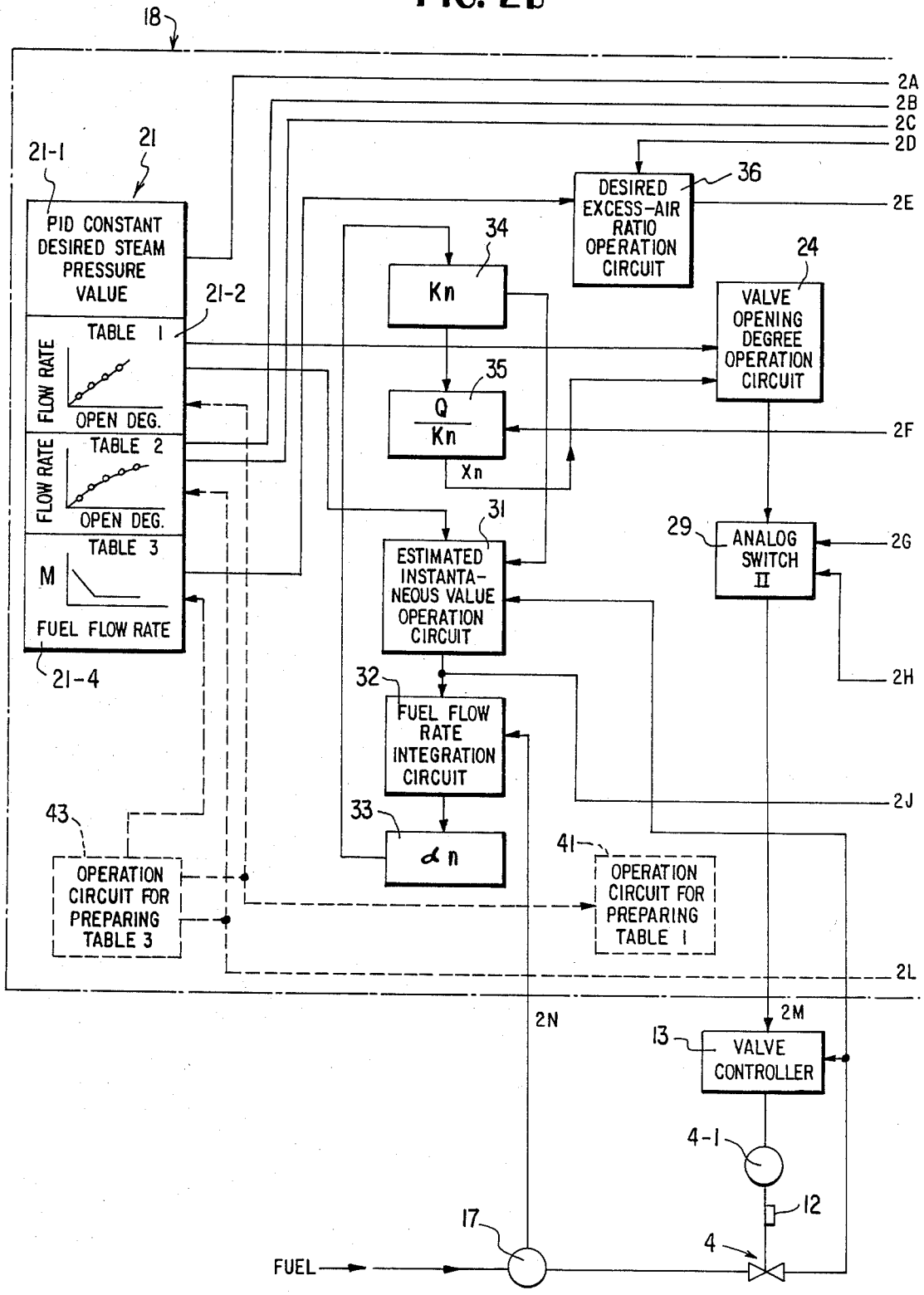
Figure 2C:
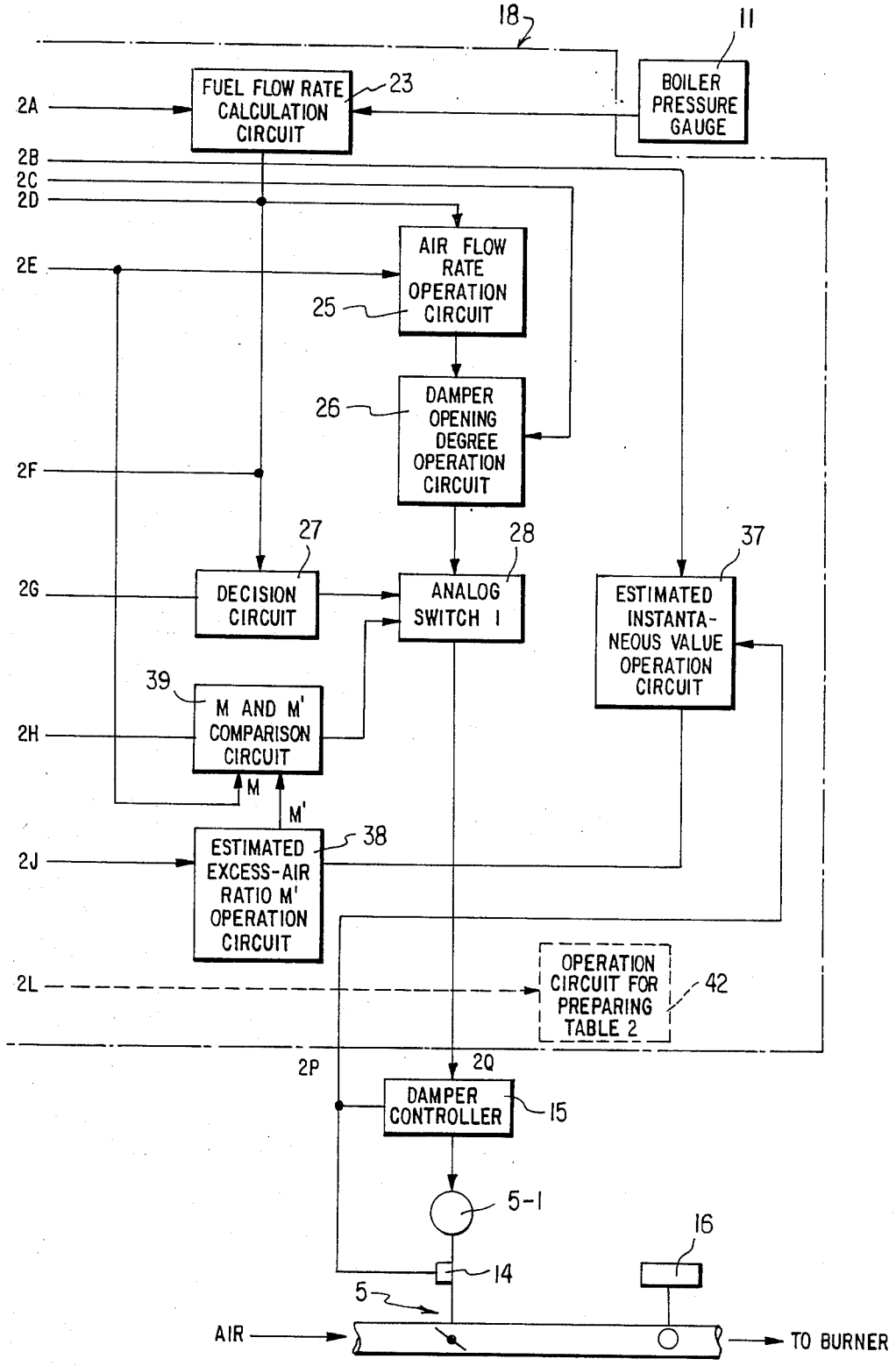

In FIGS. 2*a*–2*c*, reference numeral 21 indicates a random access memory, which is hereinafter referred to as RAM.

A first zone 21-1 of the RAM 21 is adapted to store data 22-1 indicating a desired steam pressure value of the boiler 1 which is the control object of the control system according to the present invention and data 22-2 indicating P.I.D. constants (proportion, integration, differentiation constants) of the combustion system shown in FIG. 1 for calculating the flow rate of fuel corresponding to the desired steam pressure value under a P.I.D. control mode. These data 22-1 and 22-2 are inputted into the first zone 21-1 by data input operation switches such as ten keys (not shown) in the console 19.

Figure 3:
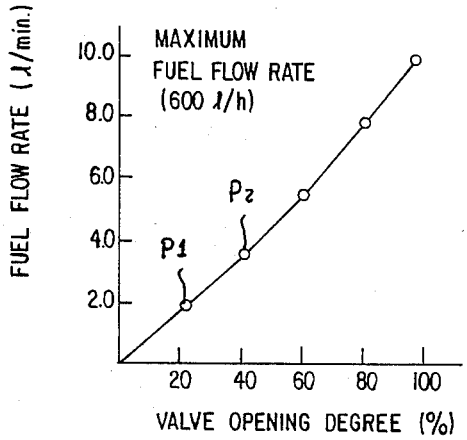
FIG. 3 is a graph showing an example of the relation between the valve opening degree and the fuel flow rate applicable to the system shown in FIG. 1.

A second zone 21-2 of the RAM 21 is adapted to store, e.g., a function formula representative of the relation between the opening degree (%) of the control valve 4 and the oil flow rate (l/min.) as shown in FIG. 3, and a third zone 21-3 is adapted to store, e.g., a function formula representative of the relation between the opening degree (%) of the air damper 5 and the air flow rate (%), i.e., the percentage with respect to the maximum flow rate.

Such function formulas between the opening degree of the control valve 4 and the oil flow rate and the opening degree of the air damper 5 and the air flow rate can be determined on the basis of data obtained by preliminary operation in advance to actual operation of the boiler 1.

That is, when the boiler 1 is preliminarily operated, the oxygen density analyzer 16 and the integrating flow meter 17 are operated. Then an expected opening degree (%) 22-4 of the control valve 4 with respect to the designated flow rate (1/min.) is set in the valve controller 13 and a designated damper opening degree (%) having sufficient allowance with respect to the expected damper opening degree (%) is set on the basis of an experiential estimate so that the boiler 1 can be operated without imperfect combustion. Thereafter the boiler 1 is preliminarily operated so as to obtain data 22-3 indicating the detected fuel flow rate (l/min.) measured by the integrating flow meter 17 corresponding to the opening degree (%) of the control valve 4 represented by the potentiometer 12 as well as data 22-5 representative of the detected density ($O_2$) of oxygen contained in the exhaust gas measured by the oxygen density analyzer 16 corresponding to the designated opening degree (%) 22-6 of the air damper 5 represented by the potentiometer 14. These data 22-3 and 22-5 are inputted into the main controller 18 through the console 19.

Figure 4:
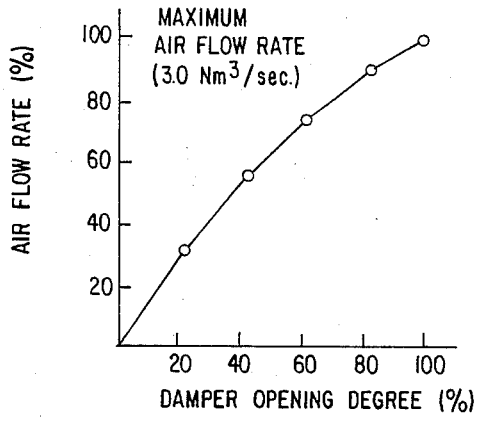
FIG. 4 is a graph showing an example of the relation between the damper opening degree and the air flow rate applicable to the system shown in FIG. 1.

As shown in FIGS. 3 and 4, five varieties of designated values are selected with respect to each of the opening degree (%) of the valve 4 and the opening degree of the damper 5 corresponding to the designated opening degree of the valve 4.

Every time data 22-3 and 22-5 are inputted into the system, as hereinabove described, function formulas representative of the relation between the opening degree of the control valve 4 and the fuel flow rate and the relation between the opening degree of the damper 5 and the air flow rate as shown in FIGS. 3 and 4 are respectively obtained in operation circuits 41 and 42 of the main controller 18 on the basis of the inputted data, and the function formulas are stored in the second zone 21-2 and the third zone 21-3 of the RAM 21.

In the operation circuit 42, the detected value ($O_2$) representative of the density of oxygen contained in the exhaust gas is converted into a value representative of the air flow rate $a_0$ according to the following formula (1):

$$a_0 = q \times A_0 \times 21/(21-[O_2]) \quad (1)$$

in which q represents the fuel flow rate from a fuel integration circuit 32 (hereinafter described in detail) and $A_0$ represents a theoretical amount of air.

Figure 5:
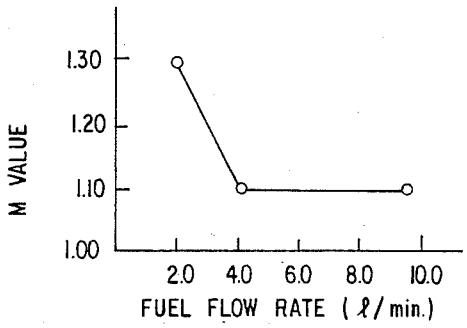
FIG. 5 is a graph showing an example of the relation between the fuel flow rate and the excess-air ratio M applicable to the system shown in FIG. 1.

A fourth zone 21-4 of the RAM 21 is adapted to store, e.g., the relation between the fuel flow rate (l/min.) and an excess-air ratio M as shown in FIG. 5. The function formula is obtained by, as shown by the broken line, an operation circuit 43 of the main controller 18 on the basis of data 22-7 indicating excess-air ratios M appropriately selected with respect to fuel flow rates (l/min.) at, e.g., three operation points of the boiler 1, respectively.

Reference numeral 23 (FIG. 2*c*) indicates a fuel flow rate calculation circuit for calculating the fuel flow rate corresponding to the desired steam pressure value of the boiler 1 by performing known P.I.D. operation on the basis of the data from the first zone 21-1 of the RAM 21 and the detected steam temperature from the pressure gauge 11 for detecting the steam pressure of the boiler 1.

The fuel flow rate calculation circuit 23 has a known limiter (not shown) which is adapted to output a signal representative of the calculated fuel flow rate only when the absolute value of variation of the fuel flow rate is within the range of a predetermined allowable limit.

An estimated instantaneous value of the fuel flow rate is calculated by an operation circuit 31 per every control cycle of the fuel combustion control system, e.g., every one second, on the basis of a signal representative of the opening degree of the valve 4 fed from the potentiometer 12 and a signal representing the function formula of the opening degree of the fuel flow rate fed from the second zone 21-2 of the RAM 21.

The operation circuit 31 calculates the estimated instantaneous value x of the fuel flow rate on the basis of the following formula (2):

$$x = ((f-a)/b)) \times Kn \quad (2)$$

in which f represents the detected opening degree (%) of the control valve 4 fed from the potentiometer 12, a represents a constant with respect to a function $F(x) = a + bx$ and b represents a coefficient with respect to said function F(x), both of which are read from the zone 21-2, and Kn represents a compensation coefficient which is hereinafter described in detail.

An estimated integrated value of the fuel is calculated by the fuel integration circuit 32 which integrates the estimated instantaneous fuel value x fed from the circuit 31 for a period Tn which is defined by a pulse interval fed from the integrating flow meter 17. The fuel integration circuit 32 is an incremental counter which starts increment of the value x in response to one pulse fed from the integrating flow meter 17 and ends said increment of the value x when the subsequent pulse is generated from the integrating flow meter 17, namely when an actual supply volume C of the fuel to the boiler 1 becomes 10 l. When said subsequent pulse is received from the integrating flow meter 17, the increment value in the fuel integration circuit 32 is applied to a first compensation coefficient operation circuit 33 and the fuel integration circuit 32 is reset.

The first compensation coefficient operation circuit 33 calculates a standard compensation coefficient $\alpha n$ for compensating the fluctuation, i.e., the error in the value of the relation between the fuel flow rate and the opening degree of the value stored in the second zone 21-2 caused by fluctuation in physical characteristics of the fuel used in the fuel combustion control system, e.g., viscosity, by the following formula (3):

$$\alpha n = 1 + (1 - Bn/C) \times \beta \quad (3)$$

in which $\alpha n$ represents a standard compensation coefficient calculated on the basis of an nth pulse applied from the integrating flow meter 17 after the fuel combustion control system is turned on, Bn represents an estimated supply volume (l) of the output from the fuel integration circuit 32 calculated on the basis of the nth pulse from the integrating flow meter 17, C represents the aforementioned actual supply volume 10 (l), and $\beta$ represents a coefficient less than 1, e.g., 0.5, which is appropriately selected so as to avoid excessive compensation.

The standard compensation coefficient $\alpha n$ from the first compensation coefficient operation circuit 33 is applied to a second compensation coefficient operation circuit 34.

The second compensation coefficient operation circuit 34 calculates a compensation coefficient Kn for compensating the relation between the fuel flow rate and the opening degree of the control valve 4 on the basis of the value $\alpha n$ fed from the first compensation coefficient operation circuit 33 in accordance with the following formula (4):

$$Kn = K_{n-1} X \alpha_{n-1} \quad (4)$$

in which $\alpha_{n-1}$ represents a standard compensation coefficient calculated by the second compensation coefficient operation circuit 34 on the basis of an nth pulse from the integrating flow meter 17 after the fuel combustion control system is turned on, and the value of $\alpha_1$ is 1 and $K_{n-1}$ represents a compensation coefficient calculated by the second compensation coefficient operation circuit 34 at the time when the nth pulse from the integrating flow meter 17 is outputted, and the value of $K_1$ is 1.

The second compensation coefficient operation circuit 34 has a register (not shown) adapted to store the calculated compensation coefficient Kn. The contents of the register are updated every time the coefficient Kn is calculated.

Reference numeral 35 indicates an operation circuit for compensating the fuel flow rate, which calculates a compensated value xn shown in the formula (5) on the basis of the desired fuel flow from the fuel flow rate operation circuit 23 and the compensation coefficient calculated by the second compensation coefficient operation circuit 34. The value xn is used when the opening degree (%) of the function formula F(x) of the second zone 21-2 is calculated.

$$xn = \text{desired value x of fuel flow}/Kn \quad (5)$$

The value xn from the operation circuit 35 is applied to a valve opening degree calculation circuit 24. The valve opening degree calculation circuit 24 calculates the opening degree of the control valve 4 for the desired fuel flow rate on the basis of the data xn and the function formula memorized in the second zone 21-2 of the RAM 21. Reference numeral 36 indicates an operation circuit for calculating a desired excess-air ratio M corresponding to the desired fuel flow rate on the basis of the desired fuel flow rate from the operation circuit 23 and the function from the fourth zone 21-4 of the RAM 21 and numeral 25 (in FIG. 2*c* ) indicates an operation circuit for calculating an air flow rate A corresponding to the desired fuel flow rate upon receiving the desired fuel flow rate from the operation circuit 23 and the desired excess-air ratio M according to the following formula (6):

$$A = Q \times A_0 \times M \quad (6)$$

in which Q represents the desired fuel flow rate calculated in the operation circuit 23, $A_0$ represents the theoretical air amount and M represents the desired excess-air ratio calculated in the operation circuit 36.

The opening degree of the air damper 5 corresponding to the air flow rate is calculated by a damper opening degree operation circuit 26 on the basis of the data representing the air flow rate from the operation circuit 25 and the function formula from the third zone 21-3 of the RAM 21.

Reference numeral 27 indicates a decision circuit for deciding whether the desired fuel flow rate represents the amount increasing from the present fuel flow rate to the boiler 1 or the same represents the amount decreasing therefrom upon receiving a signal indicating the fuel flow rate of the output from the operation circuit 23.

Analog switches 28 and 29 are adapted to output inputted value themselves when being ON, and in turn, when being OFF, hold such values that enter the analog switches 28 and 29 immediately before they are turned OFF and output these values.

The decision circuit 27 generates a command signal for turning the first analog switch 28 on when the variation in the fuel flow rate calculated in the operation circuit 23 is positive while generating a command signal for turning the second analog switch 29 on when the variation in the fuel flow rate calculated in the operation circuit 23 is negative.

An estimated instantaneous value of the air flow rate is calculated by an operation circuit 37 per every one control cycle, e.g., 1 second, of the fuel combustion control system on the basis of a signal representing the opening degree of the damper 5 from the potentiometer 14 and a signal representing the function formula of the relation between the air flow rate and the valve opening degree from the third zone 21-3 of the RAM 21.

The signal representative of the estimated instantaneous value of the air flow rate of the output from the operation circuit 37 and the signal representative of the estimated instantaneous value of the fuel flow rate from the operation circuit 31 are, in synchronism with each other, applied to an operation circuit 38 which calculates an estimated excess-air ratio M′ in accordance with the following formula (7). The output of the operation circuit 38 is connected to a comparison circuit 39.

$$M' = \frac{\text{estimated instantaneous value of air flow rate}}{(\text{estimated instantaneous value of fuel flow rate}) \times \text{theoretical air amount}} \quad (7)$$

The comparison circuit 39 receives the signal representing the estimated excess-air ratio M′ from the operation circuit 38 as well as receiving a signal representative of the desired excess-air ratio M from the operation circuit 36. When the sign of the variation in the desired fuel flow rate is negative and the estimated excess-air ratio M′ is less than the desired excess-air ratio M, the comparison circuit 39 applies to the first analog switch 28 a command signal for turning the same off while applying to the first analog switch 28 another command signal for turning the same on when the value M′ exceeds the value M. When the first analog switch 28 is ON, the opening degree of the damper 5 is changed in accordance with the output from the operation circuit 26 and the opening degree of the damper 5 remains unchanged when the first analog switch 28 is OFF. On the other hand, the sign of the variation in the desired fuel flow rate which is the output signal from the decision circuit 27 is positive and the estimated value M' of the excess-air ratio is less than the desired value M, the comparison circuit 39 generates a command signal to turn the second analog switch 29 OFF while applying to the second analog switch 29 a command signal for turning the same ON when the value M' is larger than the value M. When the second analog switch 29 is on, the opening degree of the control valve 4 is changed in accordance with the output from the operation circuit 24 and the changing of the opening degree of the valve 4 is stopped when the same is OFF.

The aforementioned formulas (1) through (7) are stored in a read only memory (not shown) in the main controller 18.

I. Data. Input Operation

The data 22-1 indicating the desired steam pressure value of the boiler 1 optionally selected are inputted into the first zone 21-1 of the RAM 21 by a data input operation switch (not shown) of the console 19. The data 22-2 indicating optionally selected P.I.D. constants for the fuel combustion control system are also inputted into the first zone 21-1.

Figure 7:
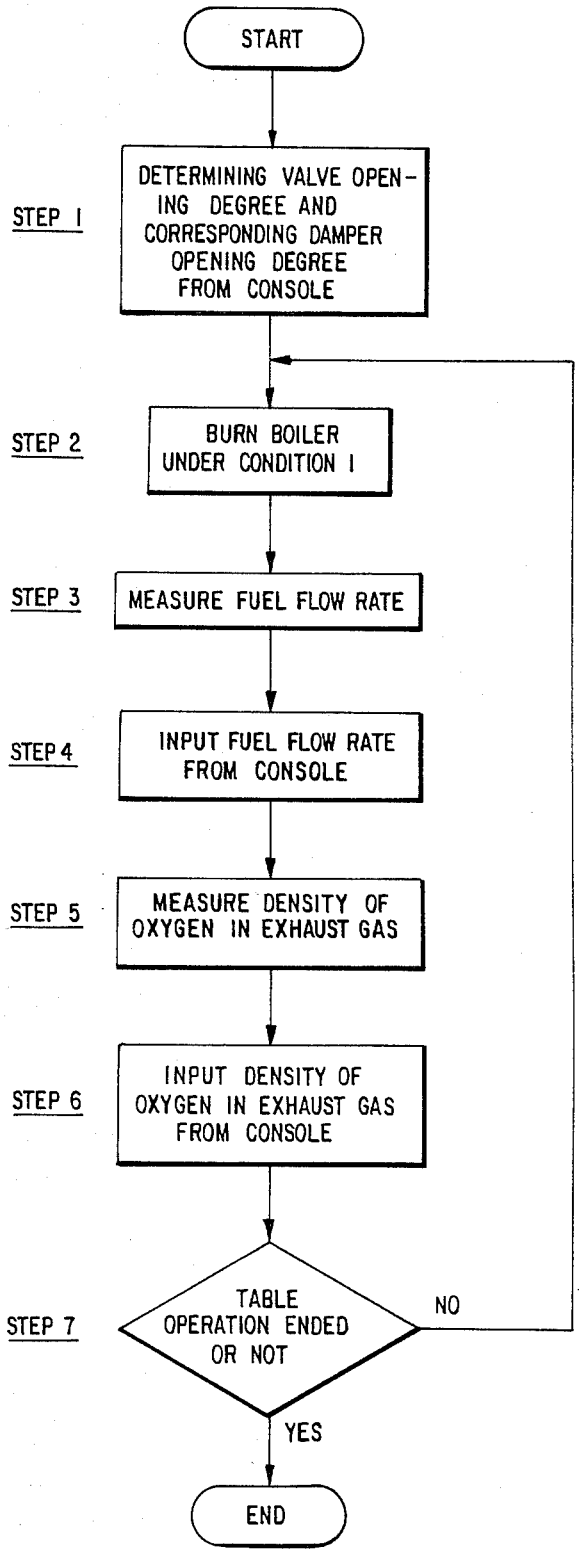
FIG. 7 is an operation flow chart in connection with data input operation in the system shown in FIG. 1.

The function formulas representative of the relation between the opening degree of the control valve 4 and the fuel flow rate and the relation between the damper opening degree and the air flow rate are obtained in accordance with the operation flow chart as shown in FIG. 7.

In the step 1, of FIG. 7 the data 22-4 indicating the opening degree of the control valve 4 substantially corresponding to an optionally selected fuel flow rate 2.0 l/min. are inputted into the second zone 21-2 of the RAM 21 by a data input operation switch (not shown) of the console 19. Then the data 22-6 indicating the opening degree of the air damper 5 substantially corresponding to the air flow rate experientially considered not imperfectly combustible with the fuel flow rate 2.0 l/min. are inputted into the third zone 21-3 of the RAM 21. The opening degrees of the damper 5 are respectively indicated by percentages with respect to the maximum opening degree of the fuel combustion control system.

In the same way as above, the data 22-4 and 22-6, respectively, indicating the opening degrees of the control valve 4 substantially corresponding to the predetermined fuel flow rate values 4.0 l/min., 6.0 l/min., 8.0 l/min. and 10.0 l/min. and indicating the similarly selected opening degrees of the damper 5 are inputted into the second zone 21-2 and the third zone 21-3 of the RAM 21. Then proceed to the step 2.

In the step 2, a boiler operation switch (not shown) of the console 19 is turned on and a signal representing the valve opening degree corresponding to the initial predetermined value 2.0 l/min. for the fuel flow rate which is inputted into the second zone 21-2 of the RAM 21 is applied to the valve controller 13 while a signal representing the damper opening degree substantially corresponding to the predetermined value 2.0 l/min. of the fuel flow rate inputted into the third zone 21-3 is applied to the damper controller 15. Then a motor 4-1 for operating the control valve 4 is driven on the basis of the output from the valve controller 13 and a motor 5-1 for operating the air damper 5 is driven on the basis of the output from the damper controller 15, thereby the boiler 1 is preliminarily operated. Then proceed to the step 3.

In the step 3, the fuel flow rate of the boiler 1 in combustion is measured by the integrating flow meter 17 utilizing a stop watch and the measured value is read out by the operator. Then proceed to the step 4.

In the step 4, the data 22-3 indicating the measured value of the fuel flow rate as read out by the integrating flow meter 17 is inputted into the second zone 21-2 of the RAM 21 by a data input operation switch (not shown) of the console 19. Then proceed to the step 5.

In the step 5, the density of oxygen contained in the exhaust gas in the boiler 1 in combustion is measured by the oxygen density analyzer 16 and the measured value is read out by the operator. Then proceed to the step 6.

In the step 6, in a similar manner as above, the data 22-5 indicating the measured value of the density of oxygen contained in the exhaust gas as read out by the oxygen density analyzer 16 are inputted into the third zone 21-3 of the RAM 21 by a data input operation switch (not shown) of the console 19. On the basis of the datum ($O_2$) representing the density of oxygen, the air flow rate $a_0$ corresponding to the datum ($O_2$) is calculated in the operation circuit 42 of the main controller 18 utilizing the same data as utilized with respect to the fuel flow rate in the second zone 21-2. This operation is performed in accordance with the aforementioned formula (1). The measured air flow rate $a_0$ is memorized in the third zone 21-3 of the RAM 21. Then proceed to the step 7.

In the step 7, it is decided whether operations in the steps 2 through 6 are completed or not with respect to all of the predetermined values of the fuel flow rate as set in the step 1.

In the step 7, when the operations of the steps 2 through 6 are decided "NO" as performed with respect to, e.g., the fourth set value 8.0 l/min. of the fuel flow rate, the operation is returned to the step 2, and the steps 2 through 6 are performed with respect to the fifth set value 10.0 l/min. of the fuel flow rate. And when the operations of the steps 2 through 6 are decided "YES" as completed, the data input operations for the second zone 21-2 and the third zone 21-3 of the RAM 21 are completed.

When a decision "YES" is made in the step 7, a function formula representative of the relation between the opening degree of the control valve 4 and the fuel flow rate is determined as shown in FIG. 3 in the operation circuit 41 in the main controller 18 on the basis of various valve opening degree data stored in the second zone 21-2 of the RAM 21 and data indicating fuel flow rates corresponding to the valve opening degrees. This function formula represents the opening degree utilizing the fuel flow rate which is a variable.

In a manner similar to the above, a function formula representative of the relation between the opening degree of the damper 5 and the air flow rate is determined as shown in FIG. 4 in the operation circuit 42 on the basis of the various damper opening degree data stored in the third zone 21-3 of the RAM 21 and data indicating the air flow rates corresponding to the damper opening degrees.

The function formulas representing the relation between the valve opening degree and the fuel flow rate and the relation between the damper opening degree and the air flow rate are respectively stored in the second zone 21-2 and the third zone 21-3 of the RAM 21.

Then, data 22-7 indicating an appropriately selected excess-air ratio M with respect to the fuel flow rate (l/min.) as supplied to the burner 2 of the boiler 1 are inputted into the fourth zone 21-4 of the RAM 21 by operating a data input operation switch (not shown) of the console 19 in a manner similar to the above. For example, as shown in FIG. 5, data indicating the excess-air ratio 1.30 with respect to the fuel flow rate 2.0 l/min., the excess-air ratio 1.10 with respect to the fuel flow rate 4.0 l/min. and the excess air ratio 1.10 with respect to the fuel flow rate 10.0 l/min. are inputted into the fourth zone 21-4 of the RAM 21. These data are inputted into the operation circuit 43, in which a function formula representative of the relation between the fuel flow rate and the excess-air ratio M utilizing the fuel flow rate as a variable is determined as shown in FIG. 5, and the function formula is stored in the fourth zone 21-4 of the RAM 21. FIGS. *6a* through *6c* show examples of data formats with respect to the function formulas stored in the second zone 21-2, the third zone 21.3 and the fourth zone 21-4 of the RAM 21.

II. Combustion Controlling Operation for the Boiler

After the aforementioned input operations of the various data are completed, combustion of the boiler 1 is controlled in accordance with the operation flow chart as shown in FIG. 8.

As hereinabove described, the desired value of the steam pressure of the boiler 1 and the P.I.D. constants are inputted into the first zone 21-1 of the RAM 21, and the value of the steam pressure of the output from the boiler 1 detected by the pressure gauge 11 is applied to the fuel flow rate operation circuit 23.

On the other hand, a signal representing the actual valve opening degree is applied to the valve controller 13 and to the estimated instantaneous value operation circuit 31 every one second of the sampling period of the fuel combustion control system from the potentiometer 12. Within the operation circuit 31, an estimated instantaneous value x of the fuel flow rate is calculated every one second by substitution of the valve opening degree (%) and the compensation coefficient Kn obtained by signals from the potentiometer 12 and the second compensation coefficient operation circuit 34 for compensation of the fuel flow rate into the aforementioned function formula (2) which is an inverted function of that stored in the second zone 21-2 of the RAM 21 (indicated by table 1 in FIG. *2a*.

A signal representing the actual damper opening degree is applied from the potentiometer 14 to the damper controller 15 and to the estimated instantaneous value operation circuit 37 of the air flow rate with intervals of 1 second. Within the operation circuit 37, estimated instantaneous values of the air flow rate are calculated every one second by substitution of instantaneous value f of the damper opening degree from the potentiometer 14 into the function formula memorized in the third zone 21-3 of the RAM 21 (indicated by table 2 in FIG. *2b*). Thus, operation of the boiler 1 is started as shown by the step 1 in FIG. *8a*.

In the fuel flow rate calculation circuit 23, P.I.D. operations are performed on the basis of the P.I.D. constants fed from the first zone 21-1 of the RAM 21 and the desired steam pressure value and the detected actual steam pressure value of the boiler 1, calculating the fuel flow rate. This operation is indicated as the step 2 in FIG. *8a*.

The calculated fuel flow rate is applied to a limiter circuit in the calculation circuit, in which a decision is made as to whether the absolute value of variation in the fuel flow rate calculated in the fuel flow rate calculation circuit 23 is within a predetermined allowable range or not. This operation is indicated as the step 3 in FIG. 8.

The desired fuel flow rate is applied to the desired excess-air ratio operation circuit 36 as well as to a data readout circuit (not shown). This readout circuit functions to read out predetermined functions F(x) from the fourth zone 21-4 of the RAM 21 on the basis of the desired fuel flow rate (l/min.) from the fuel flow rate calculation circuit 23 and to apply the signal indicating the function F(x) to the operation circuit 36.

For example, when the desired fuel flow rate is 3.5 (l/min.), the readout circuit decides by comparison that the desired fuel flow rate 3.5 (l/min) is within the range of the fuel load fuel flow rate) 2.0 (l/min) to 4.0 (l/min.) of the data format as shown in FIG. *6c* and reads out the function $F(x)=1.5-0.1x$ from an address a431 of the fourth zone 21-4 corresponding to said range. The read functio $F(x)=1.5-0.1x$ is applied to the operation circuit 36, in which the desired excess-air ratio $M=(1.5-0.1\times 35)=1.15$ is calculated by substitution of the aforemeIntioned desired fuel rate 3.5 (l/min) into the variable x of the function F(x). This operation in the operation circuit 36 with respect to the desired excess-air ratio M is indicated as the step 4 in FIG. *8a*.

On the other hand, the operation circuit 31 applies the estimated instantaneous value of the fuel flow rate to the fuel flow rate integration circuit 32, and the integrating flow meter 17 applies one pulse to the integration circuit 32 every time it detects that the fuel supply from the oil tank 3 to the control valve 4 becomes 10 l. The integration circuit 32 accumulates the estimated instantaneous values received from the operation circuit 31 every second from a time when the same is set upon receiving one pulse from the integrating flow meter 17 to a time the same is reset by receiving the subsequent pulse from the integrating flow meter 17. That is, the integration circuit 32 performs integrating operation for calculating an estimated supply volume Bn(l) of the fuel for a period corresponding to the interval of the pulse received from the integrating flow meter 17. This operation in the fuel flow rate integration circuit 32 is indicated as the step 5 in FIG. *8a*.

The output signal from the fuel flow rate integration circuit 32 is appled to the first compensation coefficient operation circuit 33. In this operation circuit 33, operation of the formula (3) is performed to calculate a standard compensation coefficient $\alpha n$. As seen from the formula (3), the standard compensation coefficient $\alpha n-1$ shows 50% of the fluctuation rate of the characteristics of the relation between the fuel flow rate and the valve opening degree from the time of preparation of the table 1 within a period from the time the operation circuit 33 receives the nth pulse from the integrating flow meter 17 to the time it receives the (n+1)th pulse from the integrating flow meter 17. This operation of the operation circuit 33 is indicated by the step 6 in FIG. *8a*.

The output signal from the first compensation coefficient operation circuit 33 is applied to the second compensation coefficient operation circuit 34. In this operation circuit 34, operation of the formula (4) is performed to calculate the compensation coefficient Kn. The output signal from the operation circuit 34 representing the compensation coefficient Kn is applied to an operation circuit 35 for compensating the fuel flow rate. This operation circuit 35 functions to calculate the compensated fuel flow rate xn by the desired fuel flow rate x received from the calculation circuit 23 and the compensation coefficient Kn in accordance with the formula (5) utilizing the table 1 stored in the second zone 21-2 of the RAM 21 for calculation of the valve opening degree (%) with respect to the desired fuel flow rate x.

Figure 8A:
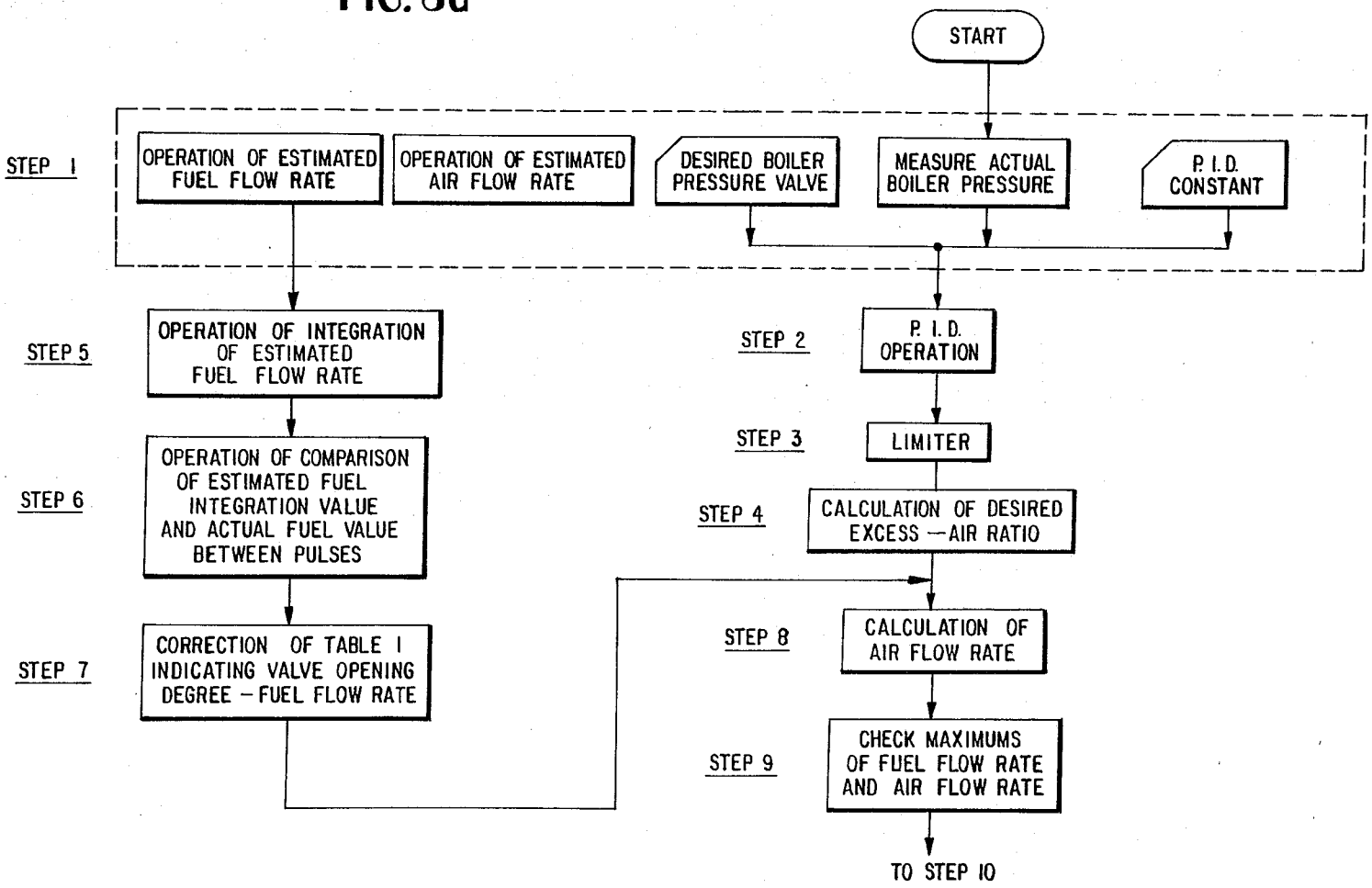
FIG. 8 is comprised of FIGS. 8*a* and 8*b* showing an operation flow chart in connection with the fuel combustion control system according to the present invention.

The operations in the operation circuits 34 and 35 are indicated as the step 7 in FIG. 8*a*.

Then the output signal from the operation circuit 35 representing the compensated fuel flow rate xn is applied to the valve opening degree operation circuit 24 as well as to a readout circuit (not shown) in a similar manner to the aforementioned step 4. The readout circuit functions to read out a predetermined function F(x) corresponding to the compensated fuel flow rate xn from the second zone 21-2 of the RAM 21 and, in turn, applies the function F(x) to the valve opening degree operation circuit 24.

When, for example, the compensated fuel flow rate xn of the output from the operation circuit 35 corresponds to 3.4 l/min., the readout circuit decides that the compensated fuel flow rate of 3.4 l/min. is within the range 1.8 l/min. to 3.6 l/min. of the fuel flow rate of the data format as shown in FIG. 6*a*, and reads out the function $F(x)=0+11.67x$ of the relation between the fuel flow rate and the valve opening degree from an address a232 of the second zone 21-2 of the RAM 21 corresponding to said range. The function F(x) represents the valve opening degree (%) utilizing the fuel flow rate as a variable x (l/min.), and the numerical value 11.67 is a coefficient representing a straight line which links operation points P1 and P2 at which the fuel flow rates detected by the flow meter 17 are 1.8 l/min. and 3.6 l/min. respectively when the boiler 1 is operated with the valve opening degrees of 21% and 42% in the aforementioned preliminary operation (see FIG. 3).

The signal representing the function $F(x)=0+11.67x$ thus read out from the readout circuit is applied to the valve opening degree peration circuit 24, in which the valve opening degree $(0+11.67\times3.4)$ (%) is calculated by substitution of the compensation fuel flow rate of 3.4 l/min. into the variable x of the function F(x).

On the other hand, the desired fuel flow rate fed from the fuel flow rate calculating circuit is applied to the air flow rate calculation circuit 25 while the desired excess-air ratio M fed from the operation circuit 36 is applied to the air flow rate calculation circuit 25, so that the air flow rate A (%) is calculated in accordance with the formula (6) as stored in a read only memory (not shown). The operation in the operation circuit 25 is indicated as the step 8 in FIG. 8*a*.

The air flow rate thus calculated is checked in the limiter circuit provded in the circuit 25 whether the value of the air flow rate is within a predetermined allowable range This operation is indicated as the step 9 in FIG. 8*a*.

Then the calculated air flow rate from the air flow rate calculation circuit 25 is applied to the damper opening degree operation circuit 26 as well as to the aforementioned readout circuit (not shown). In a manner similar to that described above, the readout circuit reads out a predetermined function formula from the third zone 21-3 of the RAM 21 on the basis of the air flow rate represented by the signal from the operation circuit 25 and applies a signal representing said function formula to the damper opening degree operation circuit 26. The damper opening degree operation circuit 26 calculates the opening degree of the air damper 5 with respect to the air flow rate by substitution of the air flow rate from the operation circuit 25 into the variable x of the function F(x) as read from the third zone 21-3 of the RAM 21 in a manner similar to the valve opening degree operation circuit 24.

The opening degree of the control valve 4 for the desired fuel flow rate corresponding to the amount of contents of the boiler 1 and the opening degree of the air damper 5 for the desired air flow rate are thus determined. The operation is indicated as the step 10 in FIG. 8*b*.

The output signal from the fuel flow rate calculation circuit 23 is applied to the decision circuit 27, which decides whether the fuel flow rate from the operation circuit 23 is increasing or decreasing. This decision is made in a known manner, e.g., by deciding whether the sign indicating the variation in the fuel flow rate from the operation circuit 23 in the step 2 is positive or negative. This operation is indicated as the step 11 in FIG. 8*b*.

(A) In Case where the Desired Fuel Flow Rate is Increasing

When the desired fuel flow rate of the output from the fuel flow rate calculation circuit 23 is increasing, i.e., when a decision by the decision circuit 27 is "YES", a command signal is applied from the decision circuit 27 to the first analog switch 28 to turn the same ON.

Accordingly, the damper opening degree operation circuit 26 applies a signal representing the command value of the opening degree of the damper to the damper controller 15 through the first analog switch 28. Within the damper controller 15, the motor 5-1 is driven by the signal from the potentiometer 14 and the signal from the damper opening degree operation circuit 26 to determine the opening degree of the damper 5 so that the same corresponds to the damper opening degree as represented by the output from the operation circuit 26. This operation is indicated as the step 12-1 in FIG. 8*b*.

The estimated instantaneous value of the fuel flow rate as calculated in the operation circuit 31 and the estimated instantaneous value of the air flow rate as calculated in the operation circuit 37 in the step 1 are applied to the operation circuit 38, in which the estimated excess-air ratio M′ is calculated in accordance with the formula (7) stored in a read only memory (not shown). The output signal from the operation circuit 38 representing the estimated excess-air ratio M′ and the signal representing the desired excess-air ratio M as calculated in the operation circuit 36 in the step 4 are applied to the comparison circuit 39, which compares the desired excess-air ratio M and the estimated excess-air ratio M′.

When a decision "YES" is made in the comparison circuit 39 as the estimated excess air ratio M′ is equal to or larger than the desired excess-air ratio M, the second analog switch 29 is turned in and the operation circuit 24 applies a signal representing the desired valve opening degree to the valve controller 13, and the motor 4-1 is driven until the actual valve opening degree represented by the potentiometer 12 coincides with the desired valve opening degree, and thus determination of the opening degree of the control valve 4 is completed in the step 14-1.

On the other hand when a decision "NO" is made in the comparison circuit 39 as the estimated excess-air ratio M' is less than the desired excess-air ratio M, the comparison circuit 39 applied a command signal to the second analog switch 29 to turn the same OFF. Thus, driving of the motor 4-1 is stopped so that the opening degree of the control valve 4 remains unchanged and determination thereof is completed.

For further stabilization of the fuel combustion control system, the aforementioned comparison of the desired excess-air ratio M and the estimated excess-air ratio M' can be performed in the step 13-1 and the step 13-2 by adding to the desired value M a constant $\alpha$ corresponding to, e.g., 1% of the desired value M in consideration of allowance in operation of the control system.

(B) In Case where the Des,red Fuel Flow Rate is Decreasing

When the desired fuel flow rate calculated in the fuel flow rate calculation circuit 23 is decreasing, i.e., when a decision NO is made in the decision circuit 27, the decision circuit 27 applies a command signal to the second analog switch 29 for mainaining the same ON.

Figure 8B:
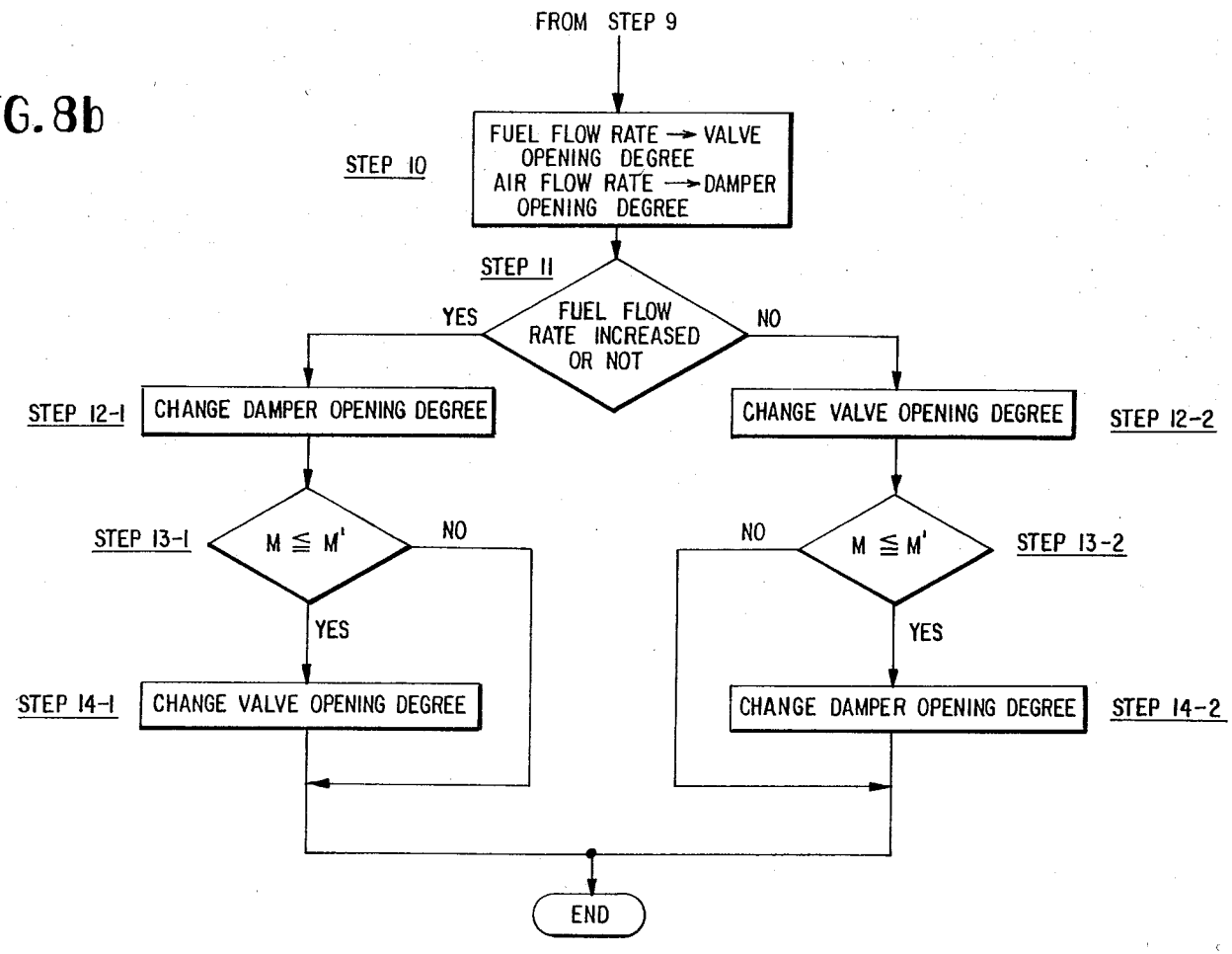

Then, in a similar manner to the aforementioned case A, the opening degree of the control valve 4 is determined in consideration of the desired fuel flow rate which is decreasing as shown by the step 12-2 in FIG. 8*b*, and thereafter the step 13-2 shown in FIG. 8*b* is performed to determine whether the step 14-2 is to be performed or not, and thereby the opening degree of the air damper 5 is determined.

Description on the operations in the steps 12-2, 13-2 and 14-2 is omitted since the operation in the step 12-2 is identical with that in the step 14-1, the operation in the step 14-2 is identical with that in the step 12-1 and the operation in the step 13-2 is identical with that in the step 13-1.

According to the present invention, as hereinabove described, the opening degrees of the fuel valve and the air damper are automatically determined on the basis of the first data indicating the relation between the fuel flow rate and the opening degree of the electric valve for controlling the fuel flow rate, the second data indicating the relation of the air flow rate with respect to the opening degree of the air damper for controlling the air flow rate and the third data indicating the relation between the fuel flow rate and the excess-air ratio which are obtained by preliminarily operating the fuel combustion control system. Since the first data are automatically renewed on the basis of compensation coefficient representative of errors in the control volume detected in the controlling cycle, the fuel flow rate and the air flow rate can be automatically controlled even if the kind and/or the quality of the fuel is changed, thereby improving the controlling accuracy and the operation workability of the fuel combustion control system.

What is claimed is:

1. A fuel combustion control system for controlling fuel flow rate and air flow rate to a burning means in a burning device by controlling respective opening degrees of fuel control valve means and air control damper means in response to change in output of the burning device which comprises pressure detecting means for detecting an output pressure of the burning device, integrating means for detecting the fuel flow rate and integrating the fuel flow rate over a predetermined period of time to produce an actual fuel flow rate first detecting means for detecting the opening degree of the fuel control valve means, first control means for controlling the opening degree of the fuel control valve means, second detecting means for detecting the opening degree of the air control damper means, second control means for controlling the opening degree of the air control damper means, storing means storing a set of predetermined data representative of a desired output value of the burning device, a set of first data representing a relationship between the opening degree of the fuel control valve means and the fuel flow rate, a set of second data representing a relationship between the opening degree of the air control damper means and the air flow rate, and a set of third data representing a relationship between the fuel flow rate and an excess air ratio, estimated fuel flow rate calculating means for determining a selected fuel flow rate from the set of first data stored in the storing means, said selected fuel flow rate corresponding to the opening degree of the fuel control valve means detected by the first detecting means and integrating the selected fuel flow rate in a predetermined period of time to calculate an estimated fuel flow rate, compensation coefficient calculating means for calculating a current compensation coefficient on the basis of the estimated fuel flow rate provided by the estimated fuel flow rate calculating means and the actual fuel flow rate provided by the integrating means, and updating a prior stored compensation coefficient stored during a prior operation by storing the current compensation coefficient, desired fuel flow rate calculating means for calculating the desired fuel flow rate on the basis of the output pressure data produced by the pressure detecting means and the desired output value of the burning device stored in the storing means, compensated fuel flow rate calculating means for calculating compensated fuel flow rate data by applying the desired fuel flow rate provided by the desired flow rate calculating means to the compensation coefficient calculated by the compensation coefficient calculating means, fuel valve control means for providing a signal for controlling said first control means by data corresponding to the compensated fuel flow rate provided by the compensated fuel flow rate calculating means, desired air flow rate calculating means for selecting data representing the desired excess air ratio from the set of third data in the storing means and for calculating a desired air flow rate on the basis of the desired excess air ratio thus selected and the actual fuel flow rate, air damper control means for determining a selected air damper opening degree signal from the second set of data in the storing means and the desired air flow rate provided by the desired air flow rate calculating means, and for applying the selected air damper opening degree signal to the air control damper means, fuel flow rate deciding means for detecting any change of the actual fuel flow rate due to lapse of time and for either providing a selected fuel valve opening degree signal when the fuel flow rate is increased or shutting off a selected air damper opening degree signal when the fuel flow rate is decreased, estimated excess air ratio calculating means for selecting an air flow rate from the second set of data stored in the memory means corresponding to the damper opening rate provided by the second detecting means and for calculating an estimated excess air ratio on the basis of the selected air flow rate and the estimated fuel flow rate provided by the estimated fuel flow rate calculating means, and comparator means for comparing the estimated excess air ratio provided by the extimated excess air ratio calculating means and the excess air ratio and for either supplying the selected fuel valve opening degree signal or releasing the shut state of the selected air damper opening degree signal when the estimated air ratio exceeds the selected desired excess air ratio.

2. The fuel combustion control system according to claim 1, wherein said burning means comprises a steam boiler.

3. The fuel combustion control system according to claim 1, wherein said first data are memorized in the form of a function formula of a first order function with the opening degree of the fuel valve means designated as a variable.

4. The fuel combustion control system according to claim 3, wherein said estimated fuel flow rate is calculated by the function formula of the first order.

* * * * *